United States Patent [19]

Kelly et al.

[11] 4,351,109

[45] Sep. 28, 1982

[54] CONTACT INSERTION/REMOVAL TOOL

[75] Inventors: William D. Kelly, Orlando, Fla.; Gregory J. Vella, Davisburg, Mich.

[73] Assignee: Balmar Crimp Tool Corp., Orlando, Fla.

[21] Appl. No.: 161,276

[22] Filed: Jun. 20, 1980

[51] Int. Cl.[3] ..... H01R 43/00

[52] U.S. Cl. ..... 29/747; 29/758; 29/764

[58] Field of Search ..... 29/747, 764, 739, 758, 29/881, 884; 294/103 R, 104, 105

[56] References Cited

U.S. PATENT DOCUMENTS

| | | | |
|---|---|---|---|
| 389,195 | 9/1888 | Charpentier | 294/103 R |
| 996,462 | 6/1911 | Curtis . | |
| 1,196,703 | 8/1916 | Kraut . | |
| 1,258,016 | 3/1918 | Kepner | 294/103 R |
| 1,559,657 | 11/1925 | Todd . | |
| 2,099,588 | 11/1937 | Anema | 294/103 R |
| 2,317,688 | 4/1943 | McDonald | 294/103 R |
| 2,371,003 | 3/1945 | Trinajstich . | |
| 3,342,090 | 9/1967 | Martin | 81/345 |
| 3,538,585 | 11/1970 | Hendry et al. | 29/747 X |
| 3,676,912 | 7/1972 | Anhalt et al. | 29/747 |
| 3,789,484 | 2/1974 | Morgan | 29/747 |
| 3,903,577 | 9/1975 | Phillips | 29/764 |
| 4,268,955 | 5/1981 | Daniels | 29/747 |

OTHER PUBLICATIONS

Military Standard MS 27495 (USAF), approved Aug. 1967.

*Primary Examiner*—Carl E. Hall

*Attorney, Agent, or Firm*—Harness, Dickey & Pierce

[57] ABSTRACT

A hand tool for inserting or removing electrical contacts from rear release connectors has an elongated body split lengthwise into a receiver and a cover each of which carries one of a pair of contact holders which are adapted to hold a contact therebetween. The cover is pivotally attached to the rear of the receiver and can be opened for changing or ejecting contacts into or from the tool. In the closed position the cover can be positioned forwardly to align the ends of the contact holders for removal, or rearwardly to misalign the ends of the contact holders for insertion, of a contact from or into a connector.

29 Claims, 11 Drawing Figures

FIG. 4.
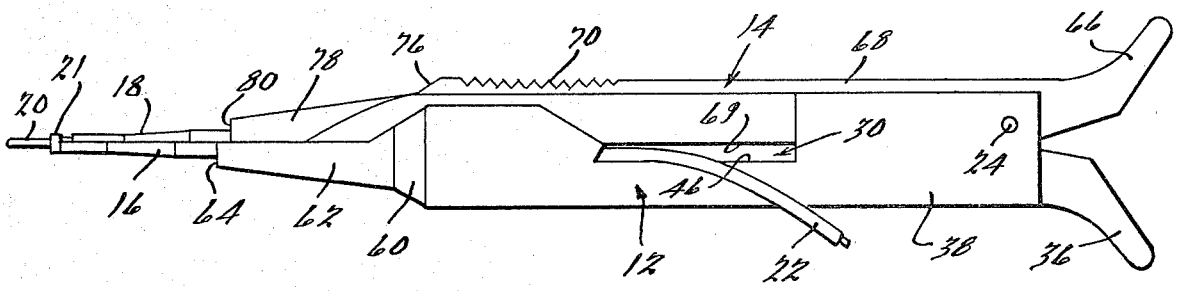
FIG. 5.
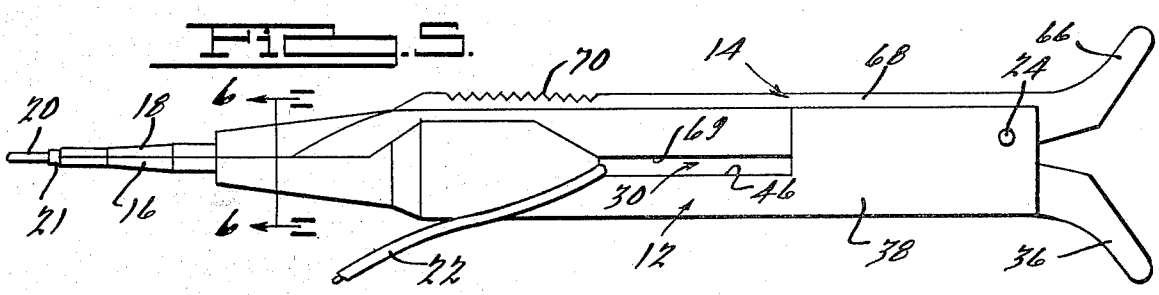
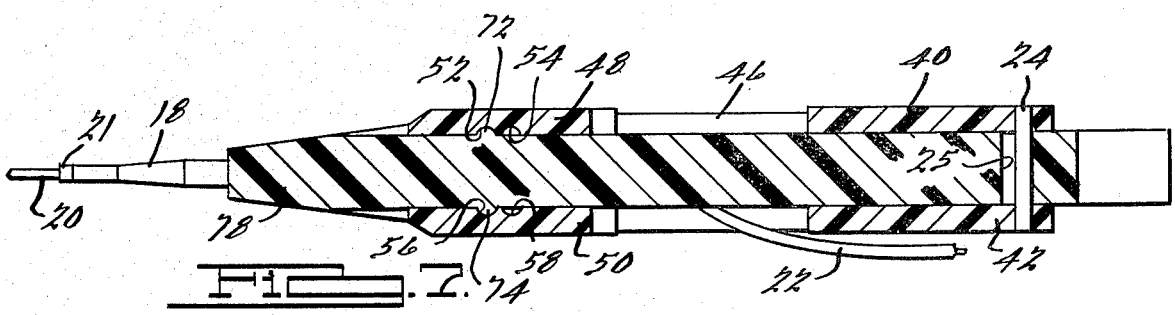
FIG. 7.
FIG. 8.
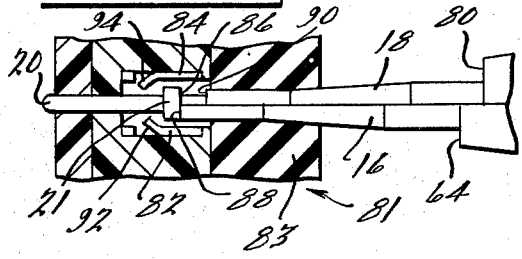
FIG. 10.
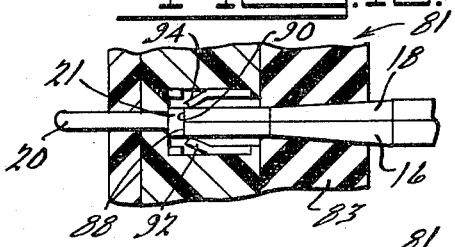
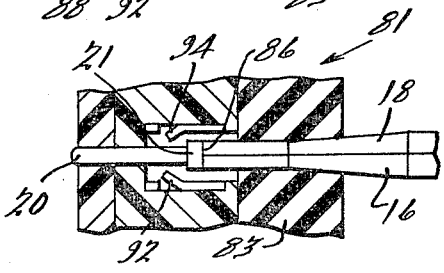
FIG. 11.
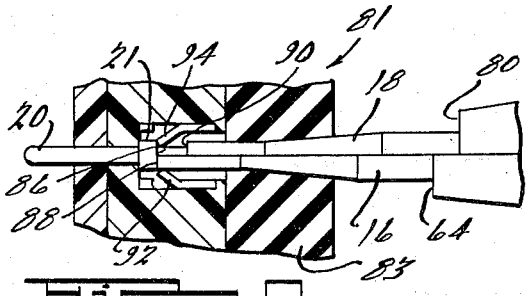
FIG. 9.

CONTACT INSERTION/REMOVAL TOOL

BACKGROUND AND SUMMARY OF THE INVENTION

The present invention relates to hand tools used to handle electrical contacts during their insertion or removal into or from rear release electrical connectors. In accordance with the present invention a single hand tool can be employed both for inserting contacts into, and for removing contacts from, a connector without changing the contact holding tips.

Electrical connectors such as rear release connector families conforming to MIL-C-38999 employ rear release pin and socket insert contacts and are particularly useful in aircraft and other electrical systems because of their reliability and space saving characteristics. Such electrical connectors are well known in the art and are characterized in part by the use of resilient fingers which engage annular shoulders on the contacts to positively lock the contacts into the connectors. Such connectors often are small, located in a crowded environment and have flexible gaskets through which contact pins must be inserted or removed. As a practical matter, special tools must be employed to handle the insertion or removal of contacts, and tools for this purpose are known in the art.

For example, one such tool is a probe-type tool which is made entirely of plastic material and has no moving parts. Another such tool is an off-set tool with a tubular tip which is split lengthwise and affixed to a tweezer frame. When pressure is applied to the frame, the tips spread to allow the contact and/or wire to enter. The tools heretofore employed for this purpose, however, generally either suffer from high cost, frequent breakage or require separate tools for insertion and removal functions.

In accordance with the present invention, an insertion/removal tool is provided which synthesizes insertion and removal capabilities into a single tool. In addition, the tool of the present invention is of a design which is adaptable to a composite construction of metal tips and a relatively inexpensive plastic body and can be economically manufactured yet is not susceptible to undue breakage. Furthermore, the tool of this invention can be conveniently and easily manipulated in use.

The contact insertion/removal tool of the present invention has an elongated body which comprises a receiver and a cover, the forward ends of which carry a pair of contact holders in facing relationship. The receiver has an upwardly open transverse notch disposed between forward and rearward upwardly open channels. The cover is adapted to fit at least partly into the channels to be aligned thereby with respect to the receiver and is pivotally attached to the rearward portion of the receiver in a manner which allows limited movement in the longitudinal direction as well as pivotal movement between an open and a closed position. The contact holders cooperate to hold an electrical contact and positioning of the cover to a forward or rearward position aligns or misaligns the end of the holders to place them in either an insertion or removal configuration. Opening of the cover allows placement or removal of a contact into or from the tool while the transverse notch provides means for accommodating the wire associated with the contact.

BRIEF DESCRIPTION OF THE DRAWINGS

FIG. 4 is a side elevational view of the embodiment of FIG. 1 with a contact pin and wire, shown closed and in an insertion configuration;

FIG. 6 is a sectional view taken along line 6—6 in FIG. 5 but with contact wire removed;

FIG. 7 is a sectional view taken along line 7—7 in FIG. 3 but with contact pin and wire added;

FIGS. 8–9 are views of a connector, shown in section and broken away, and the forward end of a tool of the present invention, shown in elevation and broken away, illustrating the operation of the present tool to insert a contact pin into a connector; and FIGS. 10–11 are views of a connector, shown in section and broken away, and the forward end of a tool of the present invention, shown in elevation and broken away, illustrating the operation of the present tool to remove a contact pin from a connector.

DESCRIPTION OF THE INVENTION

Figures 1, 2, 3, 5:
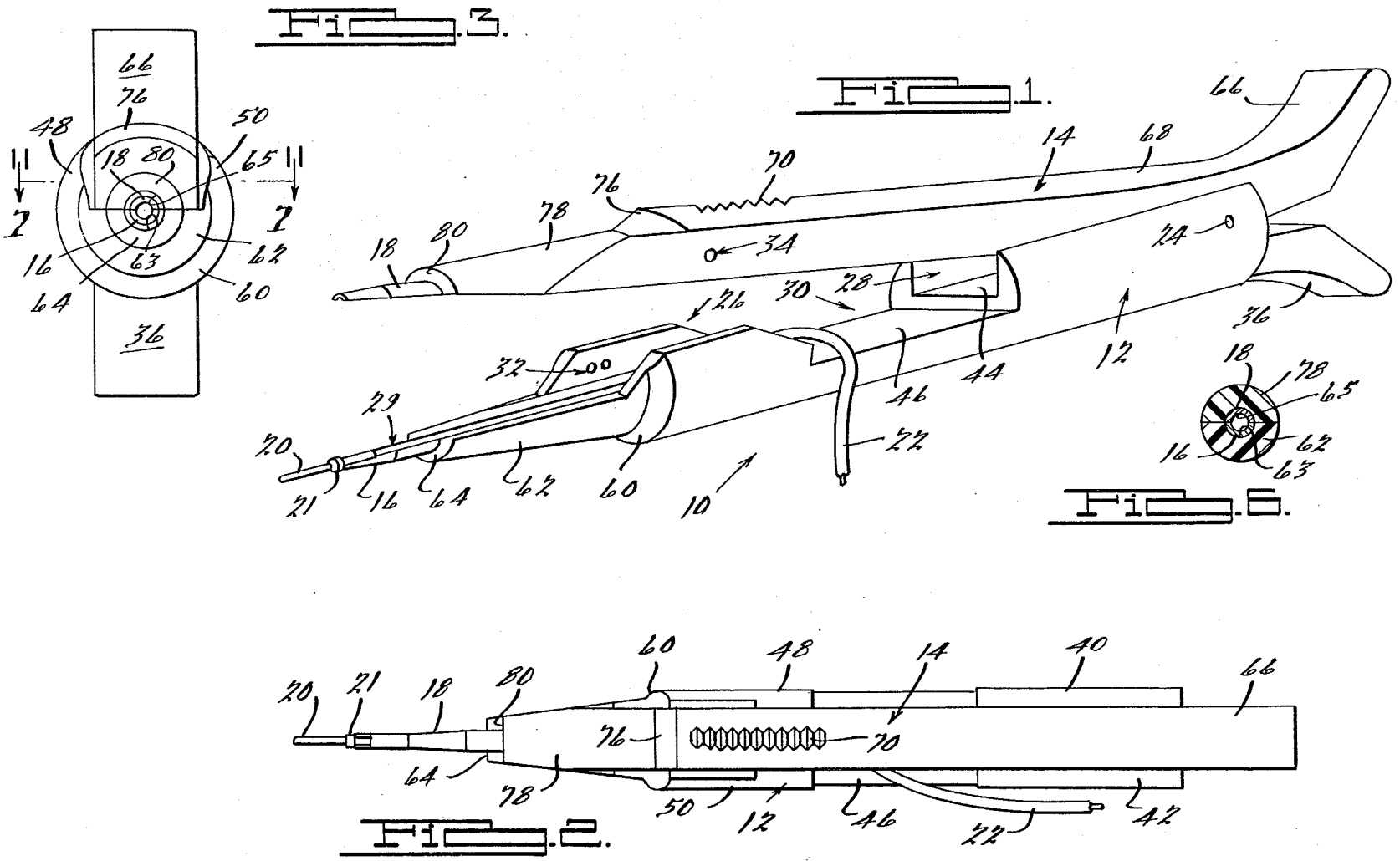
FIG. 1 is a perspective view of a preferred embodiment of a tool of the present invention with cover in an open position and charged with a contact pin and associated wire.
FIG. 2 is a top plan view of the embodiment of FIG. 1 shown with a contact pin and wire and in a closed insertion configuration.
FIG. 3 is a front view of the embodiment of FIG. 1 closed and with contact pin and wire removed.
FIG. 5 is a side elevational view, similar to that of FIG. 4, of the embodiment of FIG. 1 shown closed and in a removal configuration.

Now referring to the drawings, a contact insertion/removal tool of the present invention is shown in FIGS. 1–7 and is indicated generally by the numeral 10. Broadly speaking, tool 10 has an elongated body comprising receiver 12 and cover 14 and includes contact holder 16 carried at the forward end of receiver 12 and contact holder 18 carried at the forward end of cover 14. Contact holder 16 is an elongated member with an upwardly facing, generally semi-cylindrical groove and is generally in facing relationship to contact holder 18 which cooperates therewith to releasably hold a contact 20 for insertion into or removal from an electrical connector. In use of tool 10, annular ring 21 of contact 20 is positioned just forward of contact holders 16 and 18 while wire 22 associated therewith extends rearwardly from contact 20 and outwardly from the middle portion of tool 10. It will, of course, be appreciated that although contact 20 is illustrated herein as a contact pin, the tool 10 of this invention is equally well adapted for use with electrical contact sockets and the like.

Cover 14 is pivotally and selectively longitudinally slidably attached to receiver 12 by press fit pin 24 so that cover 14 can be manipulated to an open position, as shown in FIG. 1, to a closed rearward position as shown, for example, in FIG. 4, or to a closed forward position as shown in FIG. 5. As used herein, the terms "forward" and "rearward" are "leftward" and "rightward" and the terms "upward" and "downward" are "upward" and "downward" as viewed in the drawings.

It is contemplated that receiver 12 and cover 14 can comprise an extruded or molded polymeric plastic material while contact holders 16 and 18 can comprise a metallic material. This construction obtains the strength advantages of metal contact holders and the cost advantages of plastic materials. Manufacture of tool 10 in this composite manner combined with the feature of the present tool in being switchable between insertion and removal modes increases the utility and cost-effectiveness of the present tool.

Generally speaking, receiver 12 has an upwardly open forward channel 26, an upwardly open rearward channel 28 and an upwardly open, transversely cut notch 30 intermediate the forward and rearward channels. Forward and rearward channels 26 and 28 both serve to guide and align cover 14 with respect to receiver 12 and hence, to maintain contact holders 16 and 18 in proper alignment. In addition, press fit pivot pin 24 extends through rearward channel 28 to provide means for rearwardly pivotally attaching cover 14 to receiver 12 and forward channel 26 carries latch means 32 which cooperates with latch means 34 on cover 14 to selectively locate cover 34 in closed forward or closed rearward positions.

Disposed at the rear of receiver 12 is lever 36 which is adapted in cooperation with lever 66 of cover 14, to facilitate manipulation of tool 10 to an open configuration for charging a contact into or removing a contact from tool 10. As viewed in FIG. 1, lever 36 extends rearwardly and downwardly from body 38 of receiver 12. Just forward of lever 36 is rearward channel 28. Side walls 40 and 42 are spaced apart a distance just great enough to allow the width of cover 14 to fit therebetween and press fit pin 24 extends through sidewalls 40 and 42 for pivotal attachment of cover 14 to receiver 12. Just forward of rearward channel 28, is upwardly open notch 30 which is as if cut transversely to the longitudinal axis of receiver 12 and has an upwardly facing surface 46 positioned lower than upwardly facing surface 48 of the web of rearward channel 28. Thus, there is a gap between surface 46 of receiver 12 and downwardly facing surface 69 of cover 14. This gap serves an important function in accommodating wire 22, one end of which is connected to contact 20.

Just forward of notch 30 is forward channel 26 which has side walls 48 and 50 which are spaced apart a distance just great enough to receive the width of cover 12 therebetween. Thus, forward channel 26 and rearward channel 28 maintain cover 14 in alignment with receiver 12. In addition, forward channel 26 carries latch means 32 for selectively holding cover 14 in a closed forward or closed rearward position. Latch means 32 comprises, as is shown in FIG. 7, indentations 52, 54, 56, and 58 which cooperate with projections 72 and 74 of cooperating latch means 34 of cover 14 to snappingly engage cover 14 and receiver 12.

The forward end of receiver 12 tapers at shoulder 60 to a half frusto-conical nose 62 with forward face 64. An upwardly open longitudinally extending groove 63 extends the entire length of nose 62 and web of forward channel 26 to accommodate wire 22. The portion of groove 63 located in nose 62 is adapted to closely receive contact holder 16 which is fixedly secured thereto as by an adhesive or extrusion of nose 62 directly against contact holder 16.

Now referring to the construction of cover 14, lever 66 extends rearwardly and upwardly from body 68 of cover 14 and is adapted to cooperate with lever 36 of receiver 12 to facilitate manipulation of cover 14 to an open position. Body 68 of cover 14 is generally of rectangular cross-section and bottom surface 69 which is located a spaced distance opposite surface 46 of notch 30 to accommodate wire 22 is also spaced from surface 44 aft of pin 24 to allow pivotal movement of cover 14 about pin 24. Body 68 is pivotally attached to receiver 12 by a press fit pin 24 which extends transversely through an aperture 25 in receiver 12. As shown in FIG. 7, aperture 25 extends laterally through cover 14 but is elongated in the direction longitudinal with respect to tool 10 to permit a limited amount of sliding longitudinal movement of cover 14 with respect to receiver 12.

As has been previously mentioned, the rearward portion of body 68 fits loosely but closely into channel 28 of receiver 12 while the forward portion of body 68 fits loosely but closely into channel 26 of receiver 12. Thus, channels 26 and 28 serve to guidingly receive cover 14 to maintain the longitudinal axis thereof in alignment with receiver 12 and hence, to maintain contact holders 16 and 18 in alignment.

The top surface of body 68 has a serrated portion 70 to facilitate forward and rearward manipulation of cover 14. The forward portion of cover 14 tapers at 76 to half frusto-conical nose 78 which has a front face 80. A downwardly open groove 65 extends from face 80 of nose 78 rearwardly to notch 30 and cooperates with groove 63 to accommodate wire 22. Contact holder 18 is fixedly disposed in groove 65 in nose 80 in a manner analogous to contact holder 16 in nose 62.

Latch means 34 is carried on the sides of cover 14 and comprises a pair of small projections 72 and 74 on opposite sides of body 68. Projections 72 and 74 snappingly cooperate with one pair of indentations 52 and 56 or 54 and 58, as best shown in FIG. 7, to selectively position cover 14 in closed forward or rearward positions.

As illustrated in FIGS. 8 and 9, contact insertion/-removal tool 10 of the present can be employed to insert a contact 20 into an electrical connector in the following manner. It will be appreciated that first tool 10 is placed in an open condition as shown in FIG. 1 and a contact 20 with wire 22 attached thereto has been placed as generally shown in FIG. 1 whereupon the cover 14 is closed and pushed rearwardly with respect to receiver 12 to assume the position or configuration shown in FIG. 4. It will be noted that cover 14 is attached to receiver 10 in a manner which provides means for moving contact holders 16 and 18 both longitudinally and transversely for releasably holding a contact therebetween. It should be further noted that annular ring 21 of contact 20 is placed in abutting relationship against the forward end of contact holder 16. FIG. 8 shows the forward end of contact insertion/removal tool 10 of the present invention inserted through resilient seal 83 and into electrical connector 81 shown in section and broken away. Contact holders 16 and 18 and contact 20 are positioned proximate to resilient fingers 82 and 84 which are adapted to capture annular ring 21 of contact 20 in the manner conventional to rear release connectors. Insertion of contact 20 into connector 81 is carried out by leftward movement of tool 10, end face 88 of contact holder 16 pushing against rearwardly facing surface 86 of annular ring 21 of contact 20, until contact holders 16 and 18 and contact 20 obtain the position shown in FIG. 9, whereupon end 94 of finger 84 snaps inwardly and abuts against surface 86 of annular ring 21 to prevent withdrawal of contact 20. Thus, upon withdrawal of contact holders 16 and 18 to the right, contact 20 is retained within connector 81. Of course, once contact holder 16 is withdrawn beyond end 92 of resilient finger 82, and 92 will also snap inwardly to engage rearward face 86.

FIGS. 10 and 11 illustrate removal of a contact 20 from electrical connector 81. It will be appreciated that first, tool 10 is opened and wire 22 is placed in notch 30, between grooves 63 and 65 and contact holders 16 and 18. Tool 10 is closed and cover 14 is positioned forwardly in the position shown in FIG. 5 so that end faces 88 and 90 of contact holders 16 and 18 are flush. Tool 10 is then advanced along wire 22 and contact holders 16 and 18 are inserted through gasket 83 until end faces 88 and 90 have been inserted beyond ends 92 and 94 of resilient fingers 82 and 84. This is the position illustrated in FIG. 10. As is shown in FIG. 10, ends 92 and 94 are forced outwardly from contact 20 by contact holders 16 and 18 and no longer have a locking relationship with respect to annular ring 21 of contact 20. Thus, removal of contact 20 is easily affected by removal of contact holders 16 and 18 with contact 20 held therebetween.

It will be appreciated that while a specific form of the present invention has been described and illustrated herein, it is to be understood that the present invention may be varied within the scope of the appended claims without departing from the spirit of the invention.

What is claimed is:

1. A manually operable tool for handling electrical contacts in connectors, comprising:

a pair of longitudinally extending, generally opposed contact holders for releasably holding a contact or the like; and means for pivotally and longitudinally slidably attaching one of said holders to the other of said holders, allowing therebetween generally transverse movement for insertion therebetween of a contact or the like and longitudinal movement between an insertion position and a removal position.

2. A manually operable tool as recited in claim 1 wherein each of said holders has a forward end face and said means for pivotally and longitudinally slidably attaching one of said holders to the other of said holders permits longitudinal movement of said forward end faces between an insertion position wherein said faces are misaligned with respect to each other and a removal position wherein said faces are flush with each other.

3. A manually operable tool as recited in claim 2 including first latch means for selectively latching said holders in said insertion position and second latch means for selectively latching said holders in said removal position.

4. A manually operable tool as recited in claim 2 wherein one of said holders is fixedly attached to an elongated receiver and the other of said holders is fixedly attached to an elongated cover, said cover being pivotally and longitudinally slidably attached to said receiver.

5. A manually operable tool as recited in claim 4 wherein each of said first and second latch means has means for snap fitting one of said receiver and said cover with the other of said receiver and said cover.

6. A manually operable tool as recited in claim 5 wherein said tool has a hollow interior for accommodating a wire associated with a contact.

7. A manually operable tool as recited in claim 6 wherein each of said holders has an inwardly open groove for receiving a portion of a contact and further wherein each of said holders is made of a metallic material and said receiver and said cover are substantially made of polymeric plastic material.

8. A manually operable tool as recited in claim 7 wherein said receiver has at least one upwardly open channel therein and a portion of said cover fits closely but slidably in said channel.

9. A manually operable tool as recited in claim 8 wherein said cover is pivotally and slidably attached to said receiver by means of a pin fixedly secured in one of said receiver or said cover and extending transversely of said tool through an aperture in the other of said receiver or said cover, said aperture being elongated in a longitudinal direction with respect to said tool.

10. A manually operable tool as recited in claim 9 wherein said pin is located at the rearward portion of said tool and said first and second latch means are located at the forward portion of the tool.

11. A manually operable tool for handling electrical contacts associated with rear release electrical connectors, comprising:

an elongated receiver having a forward end portion and a rearward end portion;

an elongated cover having a forward end portion and a rearward end portion;

means for pivotally and longitudinally slidably attaching said rearward end portion of said cover to said rearward end portion of said receiver;

a first contact holder fixedly secured to said forward end of said receiver; and a second contact holder fixedly secured to said forward end portion of said cover in generally opposed relationship to said first contact holder, said elongated cover being pivotally movable between open and closed positions and longitudinally slidably movable between a first closed position in which the forward ends of said first and second contact holders are flush and a second closed position in which the forward ends of said first and second contact holders are misaligned.

12. A manually operable tool as recited in claim 11 wherein said elongated receiver has an upwardly open channel at the rearward portion thereof and an upwardly open channel at the forward portion thereof and wherein at least a portion of said elongated cover fits closely in each of said rearward and forward channels and is longitudinally aligned with respect to said elongated receiver.

13. A manually operable tool as recited in claim 12 wherein said cover has a transversely extending aperture therein, said aperture being elongated in a longitudinal direction with respect to said cover, and said means for pivotally and longitudinally slidably attaching said cover to the rearward end of said receiver comprises a transversely extending pivot pin extending through said aperture and across said upwardly open channel at the rearward portion of said receiver, opposite ends of said pivot pin being secured to said elongated receiver.

14. A manually operable tool as recited in claim 13 wherein each of said elongated receiver and said elongated cover carry cooperating latch means for selectively securing said elongated cover in closed forward and closed rearward positions.

15. A manually operable tool as recited in claim 14 wherein said cooperating latch means comprises at least one indentation in one of said receiver and said cover and at least one cooperating projection in the other of said cover and receiver.

16. A manually operable tool as recited in claim 15 wherein said elongated receiver and said elongated cover comprise polymeric plastic material and each of said first and second contact holders comprises metallic material.

17. A manually operable tool as recited in claim 16 wherein said elongated receiver has an upwardly open transverse notch between said forward and rearward channels, said notch having an upwardly facing surface spaced from said cover when said cover is in a closed position.

18. A manually operable tool as recited in claim 17 wherein each of said cover and said receiver has a rearwardly and outwardly extending lever member for manipulation of said cover to an open position.

19. A manually operable tool as recited in claim 18 wherein the forward ends of each of said receiver and said cover taper in the shape of half frusto-conical nose cones.

20. A manually operable tool as recited in claim 19 wherein said elongated receiver and said cover each have a longitudinally extending groove in a forward portion thereof, the opening of said groove in said receiver facing the opening of said groove in said cover to provide an opening for a wire.

21. A manually operable tool as recited in claim 20 wherein said cover has a serrated surface portion for manipulation thereof in a forward or rearward direction with respect to said receiver.

22. A manually operable tool as recited in claim 21 wherein said first contact holder is fixedly secured in said groove in said receiver and said second contact holder is fixedly secured in said groove in said cover.

23. A manually operable tool for handling electrical contacts associated with rear release electrical connectors, comprising:

an elongated receiver having an upwardly open channel at the forward portion thereof, an upwardly open transverse notch at an intermediate portion thereof, and an upwardly open channel at the rearward portion thereof, said upwardly open notch having an upwardly facing surface;

an elongated cover having a transversely extending aperture in the rearward portion thereof, said aperture being elongated in the longitudinal direction with respect to said cover;

a pivot pin extending across said rearward channel of said receiver and extending through said elongated aperture in said cover, said rearward channel having a pair of upwardly extending side walls and said pivot pin having opposite end portions each attached to one of said pair of side walls;

a first contact holder fixedly attached to the forward end of said receiver; and a second contact holder fixedly attached to the forward portion of said cover;

said first and second contact holders being positioned generally in facing relationship, said elongated cover being pivotally movable about said pivot pin between open and closed positions with respect to said receiver and being longitudinally slidably movable with respect to said receiver to thereby selectively position the forward ends of said first and second contact holders in flush or misaligned relationship, and said upwardly facing surface of said notch of said receiver being spaced from said cover when said cover is in a closed position.

24. A manually operable tool as recited in claim 23 wherein said elongated receiver and said elongated cover comprise polymeric plastic material and said first and second contact holders comprise metallic material.

25. A manually operable tool as recited in claim 24 wherein each of said elongated receiver and said elongated cover carry cooperating latch means for selectively securing said elongated cover in closed forward and closed rearward positions.

26. A manually operable tool as recited in claim 25 wherein said cooperating latch means comprises at least one indentation in a wall of said forward channel or said cover and at least one cooperating projection in the other of said forward channel or said cover.

27. A manually operable tool as recited in claim 26 wherein each of said cover and said receiver has a rearwardly and outwardly extending lever member which cooperate to facilitate manipulation of said cover to an open position.

28. A manually operable tool as recited in claim 26 wherein each of said elongated receiver and said cover have longitudinally extending grooves in the forward portions thereof, the opening of said grooves facing each other for accommodating a wire.

29. A manually operable tool as recited in claim 28 wherein said first contact holder is fixedly secured in said groove in said receiver and said second contact holder is fixedly secured in said groove in said cover.

* * * * *